United States Patent [19]

Oursler

[11] Patent Number: 4,861,037

[45] Date of Patent: Aug. 29, 1989

[54] PINBALL RUNWAY AND SCORING FEATURE

[75] Inventor: Barry Oursler, Elmwood Park, Ill.

[73] Assignee: Williams Electronics Games, Inc., Chicago, Ill.

[21] Appl. No.: 239,306

[22] Filed: Sep. 1, 1988

[51] Int. Cl.[4] ..... A63D 3/02

[52] U.S. Cl. ..... 273/121 D

[58] Field of Search ..... 273/29 T, 29 S, 121 D, 273/121 E

[56] References Cited

U.S. PATENT DOCUMENTS

| | | | |
|---|---|---|---|
| 2,037,108 | 4/1936 | Bechtol | 273/121 R |
| 2,101,188 | 12/1937 | Orcutt et al. | 273/119 A |
| 3,814,432 | 6/1974 | Rose | 273/123 R |
| 4,162,793 | 7/1979 | Cummings | 273/121 A |
| 4,354,680 | 10/1982 | Kmiec | 273/121 A |

FOREIGN PATENT DOCUMENTS

| | | | |
|---|---|---|---|
| 484429 | 7/1952 | Canada | 273/118 R |

*Primary Examiner*—Edward M. Coven
*Assistant Examiner*—Gary Jackson
*Attorney, Agent, or Firm*—Rockey and Rifkin

[57] ABSTRACT

This invention relates to a play feature for a pinball game. It comprises a runway or ball path with a plurality of holes disposed along the side of the runway. The holes are associated with varying scores. The skill of the player striking the plunger determines the hole through which the ball passes, thus registering a score when a wireform below the hole is depressed, signaling a score. If the ball is struck too hard, then it travels the length of the entire runway and no points are registered. One-way wire gates prevent the ball from rolling back toward the plunger.

6 Claims, 2 Drawing Sheets

PINBALL RUNWAY AND SCORING FEATURE

BACKGROUND OF THE INVENTION

This invention relates generally to pinball games and, more particularly, to a play feature for such games.

Pinball games generally consist of an inclined playfield and a plurality of targets and other play features arranged on the playfield. A player uses flippers to direct a moving ball at desired targets thereby scoring points. A spring loaded plunger is used to project the ball onto the playfield.

The players of pinball machines are selective as to the machines they choose to play and base their selections on the various types of play features offered. Therefore, the popularity of a pinball game is, in part, a function of its player appeal.

SUMMARY OF THE INVENTION

It is a general object of the invention to provide a new and improved pinball machine play feature.

A further object of this invention is to provide a novel play feature that presents alternative scoring opportunities to a player and is dependent upon the player's skill at initially projecting the ball onto the playfield.

Still another object is to provide a play feature which is economical to manufacture in terms of both the cost of the component parts and the ease and time of assembly.

Other objects of the invention, in addition to those set forth above, will become apparent to those skilled in the art from the following description.

The invention includes an inclined runway in the ball path of the plunger. A plurality of scoring holes, are provided on the runway. The force with which the ball is propelled by the plunger determines which hole, if any, the ball drops through. Each hole has a score value associated therewith. If the ball is projected with too much force, the ball travels directly to the playfield without registering any score.

Stops or one-way gates restrain the motion of the ball once it begins to roll back toward the plunger. The ball then falls through a hole and actuates the mechanism that tabulates the score.

DETAILED DESCRIPTION OF THE PREFERRED EMBODIMENTS

Figure 1:
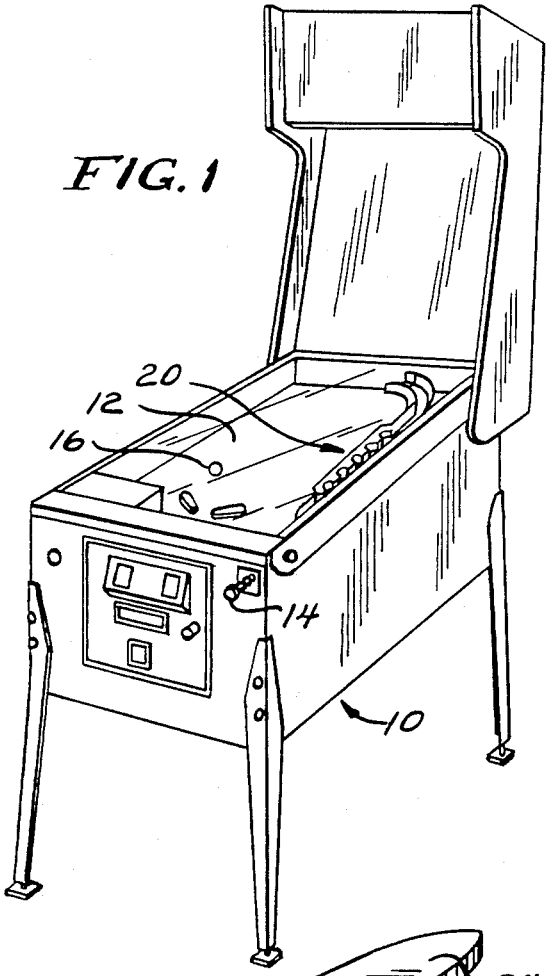
FIG. 1 is a perspective view of a pinball machine including the inclined runway of the present invention.

The runway and scoring feature of the present invention are designed to require a skillful touch when a pinball player projects the ball onto the playfield with the plunger 14. FIG. 1 depicts a pinball machine 10 with a horizontal, slightly inclined playfield 12, a plunger 14, ball 16, and the present invention generally designated as 20.

Figure 2:
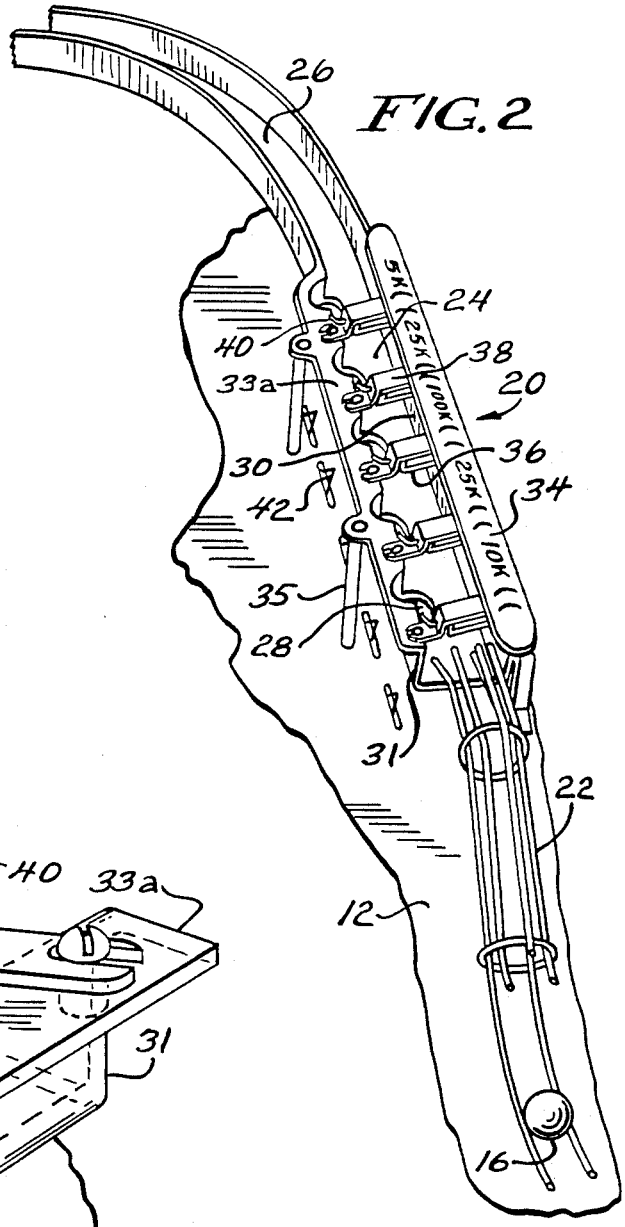
FIG. 2 depicts the present invention in perspective.
Figure 4:
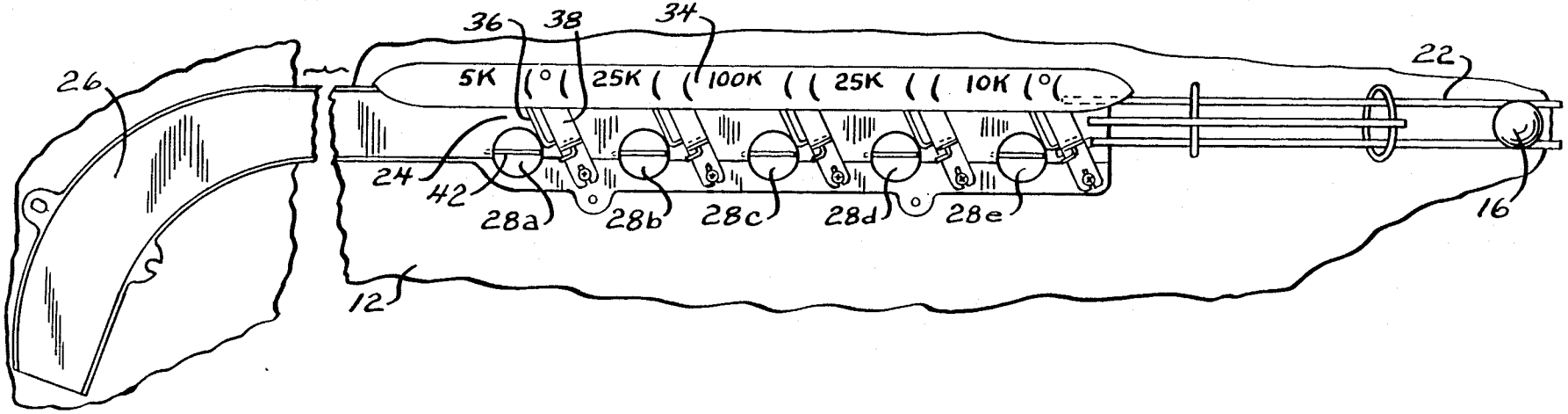
FIG. 4 is a plan view of the runway and scoring holes.
Figure 5:
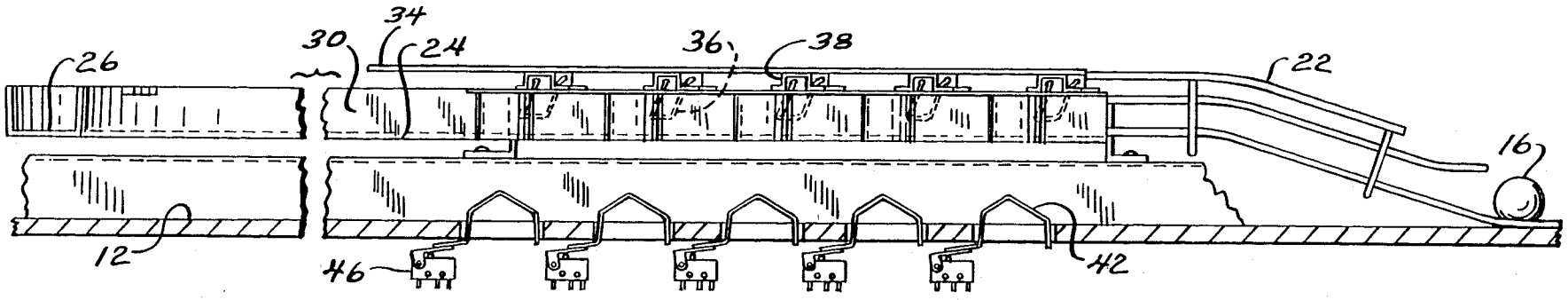
FIG. 5 is a side elevation.

As shown in FIG. 2, after the ball 16 is struck by plunger 14, it begins to travel up ramp 22 the initial portion of which includes a wire case 23 to insure that the ball, if forcefully projected, stays on the ramp. If struck with excessive force, the ball 16 will travel along ball path 24 and around ramp 26 directly onto playfield 12. The object of the present game feature, however, is to operate the plunger 14 so ball 16 will travel only part way along ball path 24, stop, and ultimately fall through one of the holes 28 adjacent to path 24. In the preferred embodiment there are different scores associated with each hole. As shown in FIG. 4, hole 28*c* represents the maximum point value, requiring a shot that is neither too hard nor too gentle. Typically, a scoring marquee 34 displays the score associated with each hole.

Figure 3:
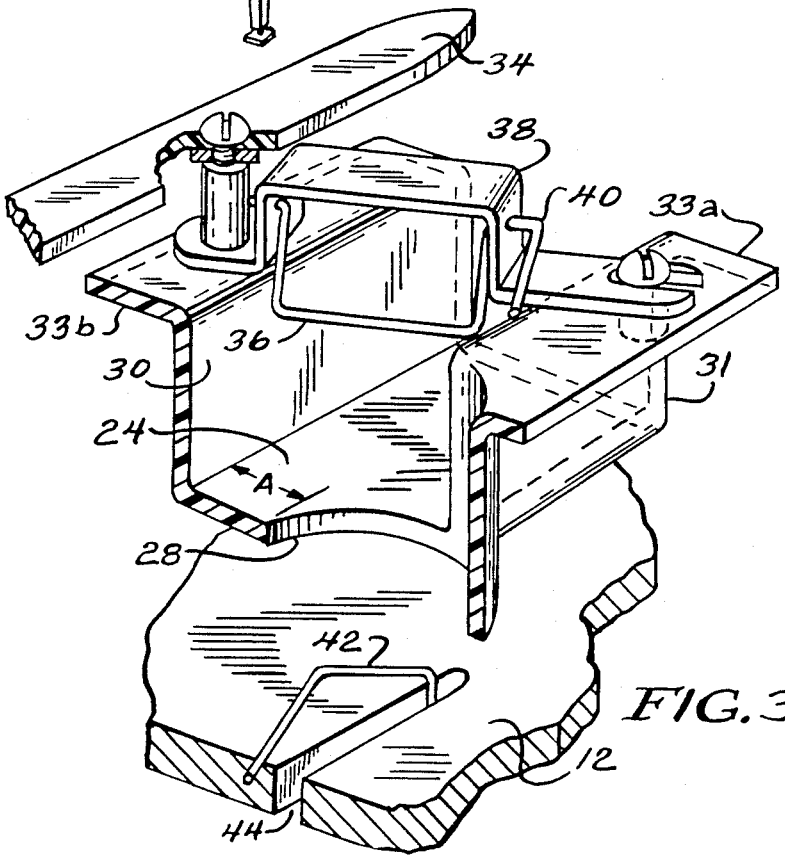
FIG. 3 is a sectional view of a scoring hole on the runway.

FIG. 3 shows how the runway and scoring feature are configured. The wire ramp 23 in FIG. 2 accurately guides ball 16 so it moves from the playfield upwardly onto ball path 24. The width of path 24, shown by double headed arrow A, is adequate for ball 16 to pass by the holes 28 without falling through. As ball 16 loses speed, however, it tends to deviate from its motion generally in contact with wall 30 and will move toward one of the holes 28. This tendency can be accentuated by canting ball path 24 from the horizontal a few degrees toward the holes.

If a player strikes plunger 14 with the proper force, the motion wall 16 will stop adjacent to one of the holes 28. To prevent undesired reverse travel a series of one-way wire gates 36 are employed. Each wire gate 36 pivots in a "C" shaped bracket 38. Stop arm 40 prevents gate 36 from rotating toward plunger 14, thus preventing reverse movement of ball 16. This insures that the ball will fall through the hole most closely associated with its loss of forward velocity. When ball 16 falls through hole 28, it strikes wireform 42 that protrudes through a slot 44 above playfield 12.

Each hole 28 is vertically disposed above, and associated with, a specific wireform 42. When ball 16 strikes a wireform 42 it actuates a corresponding switch 46 to register the score associated with particular hole 28. Once the ball 16 strikes the wireform 42 its subsequent motion is left to the game designer. For example, the ball can roll freely and encounter other game features such as targets, bumpers, and flippers, or, for example, it can roll into a catapult and be directed toward a specific location on playfield 12.

Preferably the ball path 24 and ramp 26 are formed from a unitary plastic element. Flanges 33*a* and 33*b*, to which bracket 38 and scoring marquee 34 are attached, are also part of the unitary structure. The structure is raised above playfield 12 by posts 35 secured to the playfield.

Other embodiments of the present invention are also easily conceived. For example, holes 28 could be eliminated from the bottom of the plastic channel that constitutes ball path 24. Instead, side holes could be placed in wall 31 as a means for ball 16 to exit the channel. Similarly, optical sensing devices could replace wireforms 42 and switches 46. Furthermore, the number of holes and the sequence of scores associated with them can be altered as desired by the game designer.

Various changes and modifications to the preferred embodiments described herein will be apparent to those skilled in the art. Such changes and modifications can be made without departing from the spirit and scope of the present invention and without diminishing its attendant advantages. It is, therefore, intended that such changes and modifications be covered by the following claims.

What is claimed is:

1. In a pinball game machine having an inclined playfield and a rolling ball initially projected onto the playfield by a player from one end thereof, the play feature comprising:

a ramp disposed in the path of the initially actuated ball adapted to permit the ball to roll therealong; and a plurality of scoring means, disposed along said ramp having selected score values associated therewith; said scoring means includes a plurality of openings along the length of said ramp, each opening having associated therewith means for signaling the score to be awarded, whereby the velocity of the ball determines which of said scoring means is operated.

2. The apparatus of claim 1 further comprising stop means disposed along said ramp to prevent the ball from reverse travel toward said one end of the playfield.

3. The apparatus of claim 1 further comprising means for visually indicating the score associated with each of said openings.

4. The apparatus of claim 1 wherein said means for signaling includes a wireform disposed under each of said openings, said wireforms actuating a signaling switch.

5. The apparatus of claim 1 further comprising means for initially guiding the ball smoothly onto said ramp.

6. In a pinball game machine having an inclined playfield and a rolling ball initially projected onto the playfield by a player from one end thereof, the play feature comprising:

a ramp disposed in the path of the initially actuated ball adapted to permit the ball to roll therealong; and a plurality of scoring means, disposed along said ramp having selected score values associated therewith, whereby the velocity of the ball determines which of said scoring means is operated;

said ramp extends beyond said scoring means to a portion of the playfield remote from said one end, whereby a ball can travel directly to the playfield, bypassing said scoring means.

* * * * *